United States Patent [19]

Macias

[11] Patent Number: 4,825,848

[45] Date of Patent: May 2, 1989

[54] EXHAUST SYSTEM FOR COOKING APPLIANCES

[76] Inventor: Paul C. Macias, 124 Rilla Vista, San Antonio, Tex. 78216

[21] Appl. No.: 169,159

[22] Filed: Mar. 8, 1988

Related U.S. Application Data

[63] Continuation of Ser. No. 930,326, Nov. 12, 1986, abandoned.

[51] Int. Cl.[4] ..... F24C 15/20

[52] U.S. Cl. ..... 126/299 D; 126/300; 98/115.1

[58] Field of Search ..... 126/299 D, 299 R, 300, 126/301, 302, 303, 21 R, 21 A; 98/115.1; 55/DIG. 36

[56] References Cited

U.S. PATENT DOCUMENTS

| | | | |
|---|---|---|---|
| 514,003 | 2/1984 | Hornor et al. | 126/299 D |
| 879,463 | 2/1908 | Hansen | 126/299 D |
| 1,650,859 | 11/1927 | Anderson | 126/299 D |
| 1,802,617 | 4/1931 | Mullin et al. | 126/299 D |
| 2,532,420 | 12/1950 | Pledger | 126/299 D |
| 2,874,627 | 2/1959 | Simmonds | 126/299 D |
| 3,285,154 | 11/1966 | De Rosa | 126/299 D |
| 3,980,072 | 9/1976 | Jacobs | 126/299 D |
| 3,982,588 | 9/1976 | Darm | 126/299 D |
| 4,122,834 | 10/1978 | Jacobs | 126/299 D |

FOREIGN PATENT DOCUMENTS

| | | | |
|---|---|---|---|
| 113935 | 9/1981 | Japan | 98/115.1 |
| 113936 | 9/1981 | Japan | 98/115.1 |

*Primary Examiner*—James C. Yeung

[57] ABSTRACT

An exhaust system in which heated air and fumes given off by a cooking appliance are collected by an exhaust hood and exhausted through an exhaust plenum, while burner gases are exhausted through a flute stack directly into the exhaust plenum. The exhaust hood is located above the cooking appliance and unforced make-up air is introduced over the exhaust hood, flowing nonturbulently over the periphery of the hood. Burner gases exiting the flute of the cooking appliance are exhausted through the flute stack directly into the exhaust plenum.

4 Claims, 1 Drawing Sheet

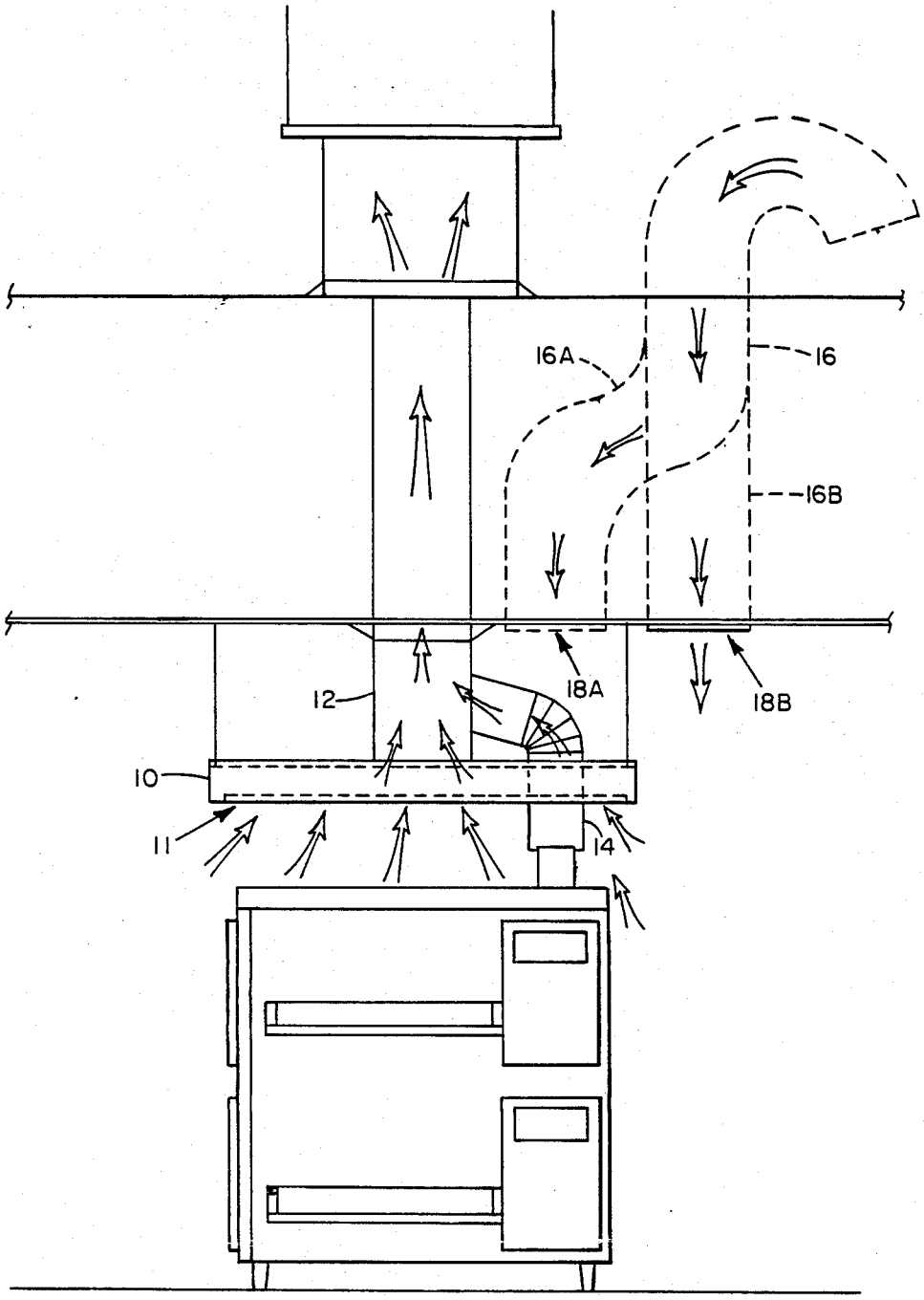
16A
16
16B
18A
18B
12
10
11
14

EXHAUST SYSTEM FOR COOKING APPLIANCES

This is a continuation of co-pending application Ser. No. 930,326 filed on Nov. 12, 1986, now abandoned.

BACKGROUND OF THE INVENTION

1. Field of the Invention

The present invention pertains to exhaust and ventilation apparatus, and particularly exhaust apparatus as is commonly used for cooking appliances.

2. Prior Art

Exhaust systems for use with commercial cooking appliances—such as grills or ovens—are well known in the prior art. Such exhaust systems ar designed to exhaust air laden with fumes and heat out of a kitchen area for improved safety and comfort.

Exhaust systems typically include (a) an exhaust or vent hood for collecting exhaust air and delivering it to an exhaust outlet system, and (b) a make-up air injection system that injects air (forced or unforced, conditioned or unconditioned) into the kitchen area to replace the exhausted air. An example is disclosed in U.S. Pat. No. 3,890,887 to Kaufman, which includes a ventilator door in the front portion of an exhaust hood so as to direct unconditioned make-up air either under the exhaust hood and toward the cooking surface, or outward and downward in front of the exhaust hood. Another example is disclosed in U.S. Pat. No. 4,475,534 to Moriarty, in which make-up air is injected both under an exhaust hood directly over the cooking surface, and above and in front of the cooking appliance so as to be drawn past a cook, over the cooking surface and out through the exhaust hood.

These exhaust systems, as well as others in the prior art, suffer from the disadvantage that make-up air injected underneath an exhaust hood tends to create turbulence under the exhaust hood over the cooking appliance. This turbulence actually tends to deflect heat arising from the cooking appliance, allowing it to escape into the kitchen area. As a result, substantial amounts of conditioned air must be provided into the kitchen area to balance the heated air that has been deflected from the cooking appliance rather than exhausted through the exhaust hood.

SUMMARY OF THE INVENTION

The present invention overcomes the inefficiencies and other disadvantages of the prior art, by providing an exhaust system in which (a) air turbulence under the exhaust hood is minimized to prevent deflection of heated air, and (b) an air curtain effect at the periphery of the exhaust hood functions to contain exhaust air beneath the exhaust hood.

Briefly, the exhaust system of the present invention includes an exhaust hood located above a cooking appliance, intermediate the appliance and the ceiling. An exhaust plenum couples the exhaust hood with an exhaust outlet system, which includes an appropriate exhaust fan/motor arrangement for extracting exhaust air. Unconditioned, unforced make-up air is injected above and in the vicinity of the exhaust hood such that the make-up air flows down over the periphery of, and is drawn under, the exhaust hood. As a result, heated air rising from the cooking appliance is contained within the area of the exhaust hood and is exhausted along with the make-up air.

In a preferred embodiment, a flute stack extends from the exhaust plenum, through the exhaust hood, to a terminus over a burner flute that releases burner gases from the cooking appliance. As a result, the hot burner gases are exhausted directly into the exhaust plenum through the flute stack, rather than being released into the open area underneath the exhaust hood, thereby reducing turbulence under the exhaust hood.

A more complete understanding of the present invention can be had by reference to the following detailed description of a preferred embodiment and the accompanying drawing.

BRIEF DESCRIPTION OF THE DRAWING

The FIGURE shows an elevation view of a preferred embodiment of the exhaust system of the present invention adapted for use in connection with a commercial oven.

DESCRIPTION OF A PREFERRED EMBODIMENT

The preferred embodiment of the exhaust system will be described in connection with its use in exhausting heated air and fumes rising from a commercial gas oven. The oven includes a burner flute that exhausts hot air and gases from the gas burners.

Exhaust System.

The exhaust system includes an exhaust hood 10 having an exhaust-air-collection area 11 substantially equal to or larger than the top surface area of the oven. Exhaust hood 10 is suspended above the oven, intermediate the top surface of the oven and the ceiling.

The specific dimensions of exhaust hood 10 are a matter of design. For maximum efficiency in collecting exhaust air, the exhaust hood should be large enough to provide an exhaust-air-collection area 11 that extends beyond the perimeter of the oven, although the basic principles of the present invention would still apply to an exhaust hood of lesser size. The exhaust hood should permit air flow over the top of the exhaust hood and down over at least a substantial portion of its periphery. For example, if a substantially square or rectangular hood is used, it may be located against a wall so as to permit air flow down over the remaining three sides.

The specific location of exhaust hood 10 above the oven is a matter of choice. For the preferred embodiment, locating the exhaust hood eight-to-twelve inches above the top surface of the oven is recommended. Locating the exhaust hood substantially closer than 8 inches may result in heat being extracted directly from the oven, making oven temperature control more difficult.

An exhaust plenum 12 couples exhaust hood 10 to the building's exhaust outlet system. The exhaust outlet system, which includes appropriate exhaust fan and motor for extracting exhaust air through the exhaust system, is standard and forms no part of the present invention.

A make-up air plenum 16 delivers unforced make-up air (conditioned or unconditioned) into the kitchen area in the vicinity of exhaust hood 10 and the oven. The FIGURE shows alternate make-up air plenum arrangements A and B.

Make-up air plenum arrangement A injects make-up air through a vent 18A directly above exhaust hood 10 into the area between the ceiling and the exhaust hood. Arrangement B injects make-up air through a vent 18B into an area displaced from, but in the vicinity of, the area between the exhaust hood and the ceiling.

The preferred make-up air plenum arrangement A injects make-up air directly over exhaust hood 10 to facilitate air flow over the exhaust hood. If building design or obstruction does not permit arrangement A, arrangement B will enable the advantages of the present invention to be realized so long as injection vent 18B is located sufficiently close to exhaust hood 10 that injected make-up air can be drawn over and around the exhaust hood.

Exhaust hood 10 is located over the oven such that the oven's burner flute will exhaust the burner gases into the area underneath the exhaust hood. However, the flow of the burner gases exhausted out of the oven flute can create turbulence that will deflect some exhaust air out from under the exhaust hood. Accordingly, for a preferred embodiment, the exhaust system includes a flute stack 14 that intersects and attaches to exhaust plenum 12, and extends through exhaust hood 10 to a terminus underneath the exhaust hood over the oven flute. At its terminus, flute stack 14 is larger in diameter than the oven flute, i.e. a vacuum seal does not exist between the flute stack and the oven flute. Flute stack 14 channels burner gases released from the oven flute into exhaust plenum 12, rather than allowing those burner gases to be released into the open area below exhaust hood 10. Because of the lack of vacuum seal between the flute stack 14 and the oven flute, exhaust flow through the oven flute is substantially not effected by the suction in the flute stack.

Operation

Heated exhaust air rises from the oven, and hot burner gases are released from the oven flute, into the area beneath exhaust hood 10. Through operation of the exhaust outlet system, exhaust air is drawn from underneath exhaust hood and exhausted through exhaust plenum 12. In a preferred embodiment, the burner gases from the oven flute are exhausted into flute stack 14 for extraction through exhaust plenum 12.

Unforced make-up air is injected through make-up air plenum 16 into the vicinity of the oven and exhaust hood 10 through either ceiling vents 18A or 18B. Make-up air is injected into the area between exhaust hood 10 and the ceiling, and flows over and around the exhaust hood. The flow of make-up air down over the periphery of the exhaust hood creates a curtain-effect around the edges of the exhaust hood. Moreover, since no make-up air is injected directly beneath exhaust hood 10, air turbulence underneath the exhaust hood is kept to a minimum. The combination of the curtain-effect created by make-up air flow down over the periphery of exhaust hood 10, and the minimization of turbulence beneath the exhaust hood, facilitates the removal of exhaust air rising from the oven.

Providing flute stack 14 to directly exhaust burner gases from the oven flute into exhaust plenum 12 further reduces air turbulence underneath exhaust hood 10, and improves the efficiency of the exhaust system of the present invention.

While the invention has been described with respect to a preferred embodiment, the invention is not so limited, but rather the limits of the invention are to be interpreted only in conjunction with the appended claims.

The embodiments of the invention in which an exclusive property or privilege is claimed are as follows:

1. An exhaust system for collecting exhaust air from a cooking appliance, including burner gases exhausted from a flute, for extraction by an exhaust outlet system, comprising:

(a) exhaust hood means for collecting exhaust air rising from the cooking appliance;

(b) said exhaust hood means being located intermediate the cooking appliance and the ceiling such that air is able to flow down over said exhaust hood means and down over at least a substantial portion of its periphery;

(c) exhaust plenum means for coupling the exhaust air collected by said exhaust hood means to the exhaust outlet system;

(d) make-up air means for introducing make-up air in the vicinity of the said exhaust hood means such that the make-up air flows non-turbulently over said exhaust hood means and is drawn into the area around the cooking appliance for collection by said exhaust hood means and exhaustion through said exhaust plenum means;

(e) flute stack means connected to said exhaust plenum means and terminating at the flute for channeling burner gases released from the flute into said exhaust plenum means; and (f) said flute stack means being larger in diameter than said flute, such that exhaust flow through said flute is substantially not affected by the suction in said flute stack created by the exhaust outlet system.

2. The exhaust system defined in claim 1 wherein said makeup air means introduces make-up air directly over said exhaust hood means.

3. The exhaust system defined in claim 2 wherein said make-up air means introduces unforced make-up air.

4. The exhaust system defined in claim 3 wherein said exhaust hood means provides an exhaust-air-collection area substantially equal to or larger than the top surface area of the oven.

* * * * *